US006070529A

United States Patent [19]

Miller

[11] Patent Number: 6,070,529

[45] Date of Patent: Jun. 6, 2000

[54] PRINTING PRESS WITH REGISTRATION CONTROL

[75] Inventor: John Jarrett Miller, N. Richland Hills, Tex.

[73] Assignee: Stevens International, Inc., Ft. Worth, Tex.

[21] Appl. No.: 09/281,881

[22] Filed: Mar. 31, 1999

[51] Int. Cl.[7] ..... B41F 5/16; B41F 5/18; B41F 13/24

[52] U.S. Cl. ..... 101/248; 101/181; 101/183

[58] Field of Search ..... 101/248, 150, 101/151, 152, 171, 174, 178, 181, 183, 216, 219, 481, 485, 486

[56] References Cited

U.S. PATENT DOCUMENTS

| | | | |
|---|---|---|---|
| 3,791,294 | 2/1974 | Skelding et al. . | |
| 3,841,216 | 10/1974 | Huffman | 101/181 |
| 3,863,566 | 2/1975 | Schirrich et al. . | |
| 4,864,927 | 9/1989 | Nieshaus | 101/181 |
| 5,127,324 | 7/1992 | Palmatier et al. | 101/248 |
| 5,239,924 | 8/1993 | Wallmann et al. . | |
| 5,570,633 | 11/1996 | Schultz et al. | 101/182 |
| 5,706,725 | 1/1998 | Kolbe et al. | 101/216 |

OTHER PUBLICATIONS

Harmonic Drive Gearing, "HDUA Differential Transmissions", Catalog No. UA–04–1997, Published by Harmonic Drive Systems Inc., 1997.

*Primary Examiner*—Kimberly Asher
*Attorney, Agent, or Firm*—Tarolli, Sundheim, Covell, Tummino & Szabo L.L.P.

[57] ABSTRACT

A printing press includes a plate cylinder defining a nip with an impression cylinder. A drive shaft is drivingly connected to the impression cylinder to rotate the impression cylinder. A first gear is mounted on the drive shaft and is drivingly connected to the drive shaft. A differential mechanism is driven by the first gear. A second gear is mounted on the drive shaft for rotation relative to the drive shaft. The second gear is rotatably driven by the differential. A third gear in mesh with the second gear drivingly connects with the plate cylinder to rotate the plate cylinder. A correction drive motor, when energized, varies the speed at which the differential drives the second gear. The correction drive motor thus varies the speed of rotation of the plate cylinder relative to the impression cylinder.

6 Claims, 2 Drawing Sheets

PRINTING PRESS WITH REGISTRATION CONTROL

FIELD OF THE INVENTION

The present invention relates to a printing unit and particularly relates to a printing unit with a registration control.

BACKGROUND OF THE INVENTION

A printing press, particularly a multi-color printing press, includes a plurality of printing units. Each printing unit prints an individual color image on a web of material, or the like, which is transferred through the printing units. The various printing units must be in register with each other so that the color image printed in the first unit is in register with the subsequent color images printed in the subsequent printing units. Various controls have been utilized for providing such registration control in a printing press.

SUMMARY OF THE INVENTION

The present invention involves a printing unit which comprises an impression cylinder rotatable about a first axis. The printing unit also includes a plate cylinder defining a nip with the impression cylinder. The plate cylinder is rotatable about a second axis spaced from the first axis. The plate cylinder prints an image on the material traveling through the nip. A drive shaft is drivingly connected to the impression cylinder to rotate the impression cylinder about the first axis in response to rotation of the drive shaft. A first gear is mounted on the drive shaft and is drivingly connected to the drive shaft to rotate with the drive shaft. A differential mechanism is driven by the first gear. A second gear is mounted on the drive shaft for rotation relative to the drive shaft. The second gear is rotatably driven by the differential. A third gear in mesh with the second gear drivingly connects with the plate cylinder to rotate the plate cylinder about the second axis.

A correction drive motor is associated with the differential for, when energized, varying the speed at which the differential drives the second gear. The correction drive motor thus varies the speed of rotation of the plate cylinder relative to the impression cylinder.

The impression cylinder drives the material being printed through the printing unit. Thus, by varying the speed of rotation of the plate cylinder relative to the impression cylinder the location at which the image applied to the material being printed by the plate cylinder will change. Thus, the correction drive motor will provide for proper location of the image on the material being printed as the material is transmitted through the nip formed by the impression cylinder and the plate cylinder.

The present invention is particularly applicable to a multi-unit printing press such as a four color printing press where each printing unit of the printing press prints a different color on material being conveyed through the various printing units.

In such a four color printing press the first printing unit prints a registration mark and an image on the web material. The registration mark is sensed at the second printing unit. A signal is provided to a controller to notify the controller of the precise location of the registration mark. Also, the angular position of the plate cylinder of the second printing unit is sensed and another signal indicative of such is provided to the controller. The controller then controls the correction drive motor and either speeds up or slows down the plate cylinder of the second printing unit depending upon the location of the registration mark relative to the angular position of the plate cylinder of the second printing unit. In this way an image printed by the second printing unit can be correctly located on the web material, which is driven through the unit by the impression cylinder, and correctly located relative to an image which is printed in the first printing unit. This process would be repeated for the third and fourth printing units.

BRIEF DESCRIPTION OF THE DRAWINGS

Further features and advantages of the present invention will be apparent to those skilled in the art to which the present invention relates upon consideration of the detailed description of the present invention and the accompanying drawings, wherein.

DESCRIPTION OF A PREFERRED EMBODIMENT

Figure 1:
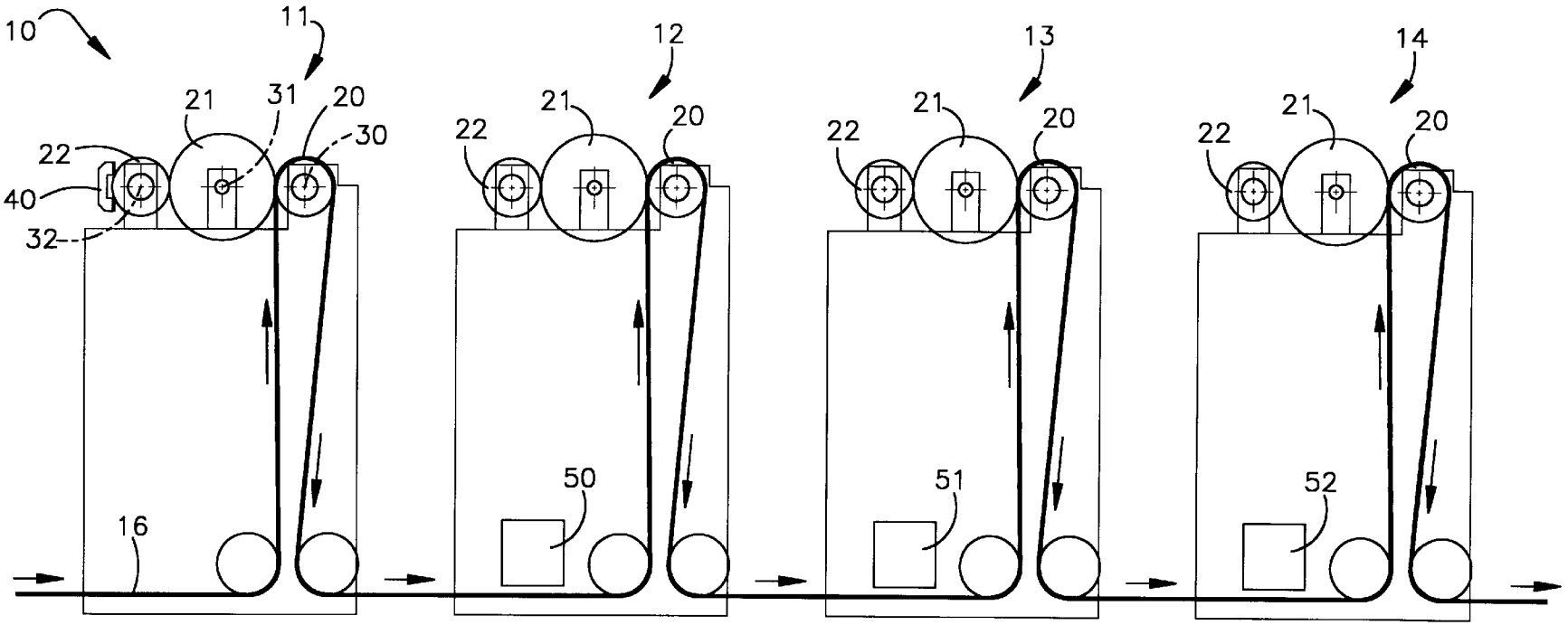
FIG. 1 is a schematic view of a multi-color printing press embodying the present invention.

FIG. 1 illustrates a multi-color printing press 10. The multi-color printing press 10 includes four printing units 11, 12, 13 and 14. The printing units 11, 12, 13 and 14 each print on a web of material 16 which is conveyed successively through the printing units. Each printing unit prints a different color on the web of material. The web of material, when it exits printing unit 14, has a four color image printed on the web.

Each of the printing units 11, 12, 13 and 14 are identical in construction. Each printing unit includes an impression cylinder 20, a plate cylinder 21, and an inker roll 22. The impression cylinder 20 rotates about an axis 30, the plate cylinder 21 rotates about an axis 31 and the inker roll 22 rotates about an axis 32. The axes 30, 31, and 32 are spaced with respect to each other. The plate cylinder 21 and the impression cylinder 20 of each printing unit define a nip through which the web of material 16 is conveyed. As the web of material 16 is conveyed through the nips each plate cylinder 21 applies an image to the web 16. The web 16 extends 180° or more around each impression cylinder 20. The frictional engagement between the impression cylinders 20 and the web 16 drives the web 16 through the press 10.

Each of the inker rolls 22 is associated with a respective ink fountain 40. The inker roll 22 is a ceramic roller and receives ink from the fountain 40 and applies the ink to the plate cylinder 21.

Each plate cylinder 21 has a raised rubber image on the outer periphery of the plate cylinder. The raised rubber image is defined by projections and recesses on a rubber plate on the outer perimeter of the plate cylinder. The rubber plate can be replaced by another rubber plate to change the image being printed. The image which is on the outer perimeter of the plate cylinder 21 is applied to the web of material 16 as the web is conveyed through the nip defined between the plate cylinder 21 and the impression cylinder 20.

The plate cylinder 21 of the printing unit 11 also prints a registration mark on the web 16. As the web 16 is conveyed from the printing unit 12 to the printing unit 13 the registration mark printed by the plate cylinder 21 of the first printing unit 11 is sensed by a suitable sensor such as a photocell 50 in the printing unit 12. The photocell 50 is located after the nip between the plate cylinder 21 and the impression cylinder 20 of the second printing unit 12. A similar sensor 51 is located after the nip defined by the impression cylinder 20 and plate cylinder 21 of the printing unit 13. Likewise, a similar sensor 52 is positioned after the nip of the plate cylinder 21 and impression cylinder 20 of the printing unit 14.

The impression cylinders of the printing units 11, 12, 13 and 14 are driven in timed relation in any suitable manner such as by having a common drive shaft or by having electronic controls for electric motors for each of the printing units.

Figure 2:
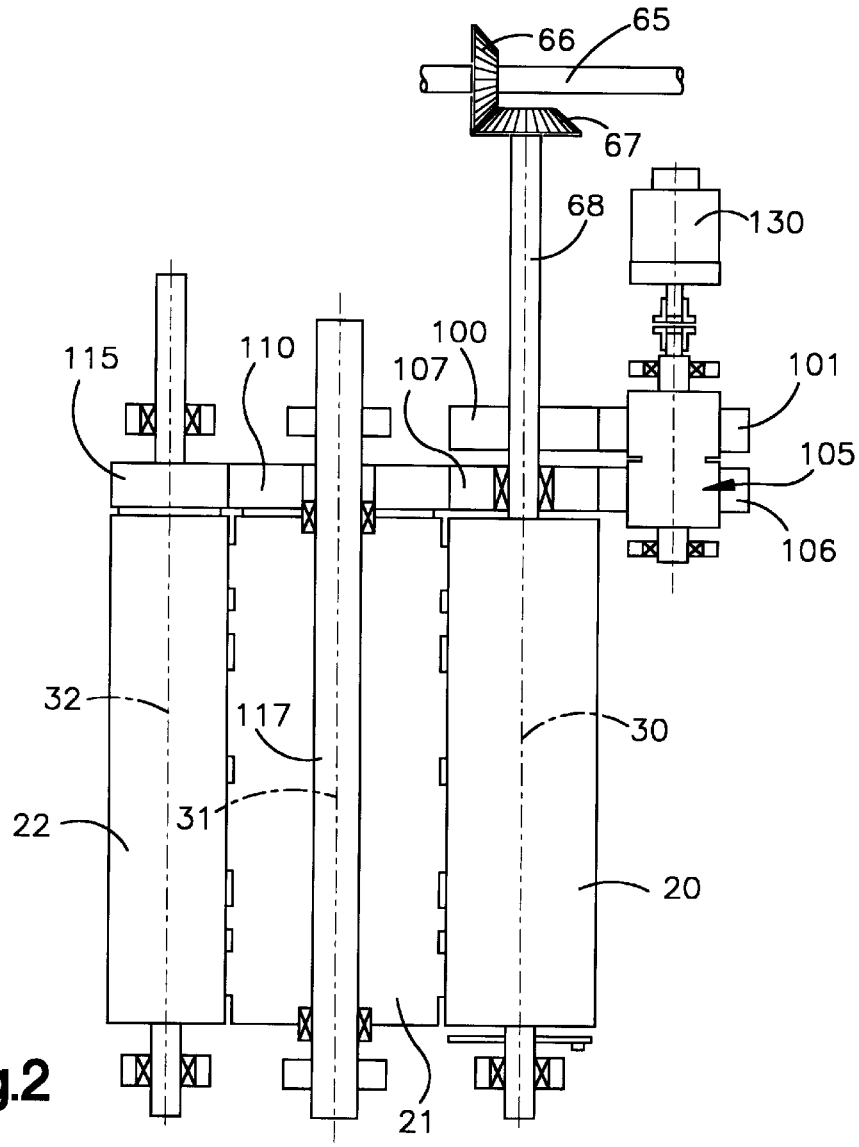
FIG. 2 is a schematic view of a printing unit of the press of FIG. 1 including a register adjustment mechanism utilized in the,printing unit.
Figure 3:
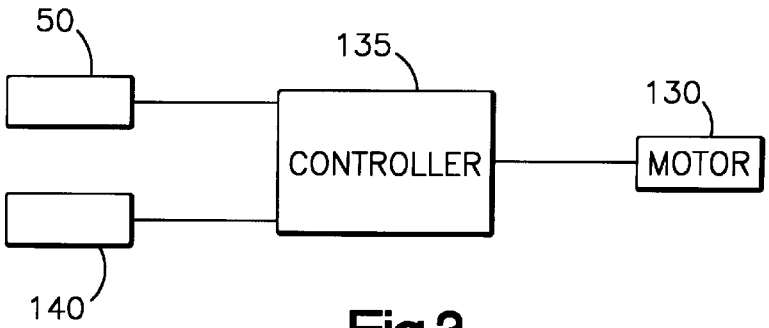
FIG. 3 is a schematic view of a control system of the press of FIG. 1.

The drive into each of the printing units 11, 12, 13 and 14 is identical to the others. FIG. 2 illustrates the drive for one of the printing units, for example the printing unit 12. As shown in FIG. 2, a drive shaft 65, which is driven in timed relation with corresponding drive shafts of the other printing units, has a bevel gear 66 drivingly connected to the drive shaft 65. The bevel gear 66 meshes with a bevel gear 67, which is fixedly (non-rotatably) mounted on a drive shaft 68. Rotation of the bevel gear 67 results in rotation of the shaft 68 about the axis 30 of the impression cylinder 20. Rotation of the shaft 68 also results in rotation of the impression cylinder 20 about the axis 30 since the shaft 68 is drivingly connected to the impression cylinder 20.

Fixedly mounted on the shaft 68 is a gear 100. The gear 100 rotates upon rotation of the shaft 68. The gear 100 meshes with a gear 101 which is an input gear to a differential 105. The differential 105 drives an output gear 106 which meshes with a gear 107. The gear 107 is rotatably mounted on the shaft 68 and rotates relative to the shaft 68 about the axis 30 of the impression cylinder. The gear 107 meshes with gear 110 which is mounted for rotation about the axis 31 of the plate cylinder 21. The gear 110 is fixedly (non-rotatably) connected to the plate cylinder 21 and upon rotation of the gear 110 the plate cylinder rotates about its axis 31. The gear 110 meshes with a gear 115 which is mounted for rotation about the axis 32 of the inker roll 22. The inker roll 22 rotates about axis 32 upon rotation of the gear 115.

The plate cylinder 21 and gear 110 rotate relative to a stationary shaft 117 on which the plate cylinder is mounted. The gear 110 is fixedly connected to the plate cylinder 21 by suitable fasteners and rotation of the gear 110 results in rotation of the plate cylinder 21. The gears 100, 101, 106, 107, 110 and 115 are all preferably gears with helical gear teeth.

Thus, the drive for the impression cylinder 21 is the drive shaft 68. The drive for the plate cylinder is from the gears 100 and 101 through the differential 105 to output gear 106, the gear 107 and the gear 110, which is drivingly connected to the plate cylinder. The inker roll 22 is driven by rotation of the gear 115 which meshes with the gear 110.

The differential 105 may be of a variety of constructions. Preferably the differential 105 is a known harmonic drive differential model HDUA, Type 2 sold by Harmonic Drive Systems Inc., 89B Cabot Court, Hauppauge, N.Y., USA. The differential 105 is well known and thus will not be described. A drawing of the differential is shown in the catalogue No. UA-04-1997, entitled HARMONIC DRIVE GEARING, printed by Harmonic Drive Systems Inc., on page 4, upper right corner of the page. The catalogue is attached to this application as prior art.

Also associated with the differential 105 is a correction drive motor 130 which comprises a reversible electric motor. Rotation of the electric motor in one direction will result in the differential 105 speeding up the rotation of the output gear 106, which results in a speeding up of the gears 107, 110. Rotation of the electric motor in the opposite direction will result in the differential 105 slowing down gears 106, 107 and 110. If the gear 110 is speeded up or slowed down, the position of the image on the plate cylinder 21 will be angularly changed relative to the impression cylinder 20 and the web 16 driven by the impression cylinder. Therefore, the location where the image is applied by the plate cylinder 21 to the web 16 will be changed.

When the plate cylinder 21 is either speeded up or slowed down there is no change in the speed of the impression cylinder 20 because the gear 107 rotates relative to the shaft 68 which is driving the impression cylinder. Therefore, there is no tension transient imparted into the web 16 due to the change in speed of the plate cylinder 21, since the web 16 is driven by the impression cylinder 20.

The registration mark which is printed by the printing unit 11 is sensed by the sensor 50 as the web 16 leaves the printing unit 12. The sensor 50 sends a signal to a controller 135 indicating the exact position of the registration mark. A sensor 140 senses the angular position of the plate cylinder 21 of the printing unit 12 and sends a signal to the controller 135 indicating the angular position of the plate cylinder 21. The sensor 140 senses a mark or the like on the plate cylinder. By comparing the angular position of the plate cylinder 21 with the position of the registration mark on the web 16, the controller 135 can provide a control signal to the correction drive motor 130 if necessary.

The control signal causes the electric motor 130 to drive in one direction or another to increase the speed of the plate cylinder 21 or decrease the speed of the plate cylinder 21 relative to the impression cylinder 20 and the web 16. Thus the position of the image printed by the plate cylinder 21 of the printing unit 12 would be adjusted relative to the web 16. Thus if an error in printing registration occurred, subsequent images printed by the printing unit 12 can be properly printed on the web 16 in registration with the image printed in the printing unit 11.

Likewise the sensors 51 and 52 can sense the registration mark and in cooperation with a sensor, such as 140, in printing units 13, 14 can control the rotary position of the plate cylinders 21 in the printing units 13 and 14 so that an image printed by the plate cylinders 21 of the printing units 13 and 14 and can be in proper register with images printed by the printing units 11 and 12. In this way a four color image in proper registration is printed on the web 16.

From the above description of the invention, those skilled in the art will perceive improvements, changes and modifications. Such improvements, changes and modifications within the skill of the art are intended to be covered by the appended claims.

Having described the invention, the following is claimed:

1. A printing press comprising:

an impression cylinder rotatable about a first axis;

a plate cylinder defining a nip with said impression cylinder, said plate cylinder being rotatable about a second axis spaced from said first axis, said plate cylinder printing an image on material traveling through said nip;

a drive shaft drivingly connected to said impression cylinder to rotate said impression cylinder about said first axis in response to rotation of said drive shaft, a first gear mounted on said drive shaft and drivingly connected to said drive shaft to rotate with said drive shaft;

a differential mechanism driven by said first gear;

a second gear mounted on said drive shaft for rotation relative to said drive shaft, said second gear being rotatably driven by said differential mechanism;

a third gear in mesh with said second gear, said third gear drivingly connected with said plate cylinder to rotate said plate cylinder about said second axis; and a correction drive motor drivingly connected with said differential mechanism for, when energized, varying the speed at which said differential mechanism drives said second gear to vary the speed of rotation of said plate cylinder relative to said impression cylinder.

2. A printing press as defined in claim 1, wherein said plate cylinder has an outer periphery made of rubber, and said outer periphery has an image defined by raised and recessed portions of the rubber outer periphery.

3. A printing press as defined in claim 2, further including an inker roll rotatable about a third axis spaced from said first and second axes for applying ink to said image on said plate cylinder, and a fourth gear in mesh with said third gear for drivingly rotating said inker roll about said third axis.

4. A printing press as defined in claim 3, wherein said inker roll is made of a ceramic material.

5. A printing press as defined in claim 3, wherein said correction motor is an electric motor.

6. A printing press comprising a plurality of printing units, each of said printing units comprising an impression cylinder rotatable about a first axis, a plate cylinder defining a nip with said impression cylinder, said plate cylinder being rotatable about a second axis spaced from said first axis, said plate cylinder printing an image on material traveling through the nip defined by said plate cylinder and said impression cylinder, a drive shaft drivingly connected to said impression cylinder to rotate said impression cylinder about the first axis in response to rotation of the drive shaft, a first gear mounted on said drive shaft and drivingly connected to said drive shaft to rotate with said drive shaft, a differential mechanism driven by said first gear, a second gear mounted on said drive shaft for rotation relative to said drive shaft, said second gear being rotatably driven by said differential mechanism, a third gear in mesh with said second gear, said third gear drivingly connected with said plate cylinder to rotate said plate cylinder about said second axis, and a correction drive motor associated with said differential mechanism for, when energized, varying the speed at which said differential mechanism drives said second gear to vary the speed of rotation of said plate cylinder relative to said impression cylinder.

* * * * *